United States Patent [19]

Geyser et al.

[11] 4,293,365

[45] Oct. 6, 1981

[54] APPARATUS FOR APPLYING LABELS OR THE LIKE

[75] Inventors: Joseph E. Geyser, Brentwood; Henry W. Rehr, Clayton; Rudolph W. Schutz, Walnut Creek; Rudolf R. Weis, Antioch, all of Calif.

[73] Assignee: Crown Zellerbach Corporation, San Francisco, Calif.

[21] Appl. No.: 174,413

[22] Filed: Aug. 1, 1980

[51] Int. Cl.[3] ..... B65C 9/10; B65C 9/14; B65C 9/36

[52] U.S. Cl. ..... 156/364; 156/568; 156/571; 156/DIG. 25; 156/DIG. 42; 156/DIG. 45; 156/DIG. 29; 156/DIG. 31

[58] Field of Search ..... 156/571, 568, 364, 542, 156/521, DIG. 2, DIG. 25, DIG. 19, DIG. 20, DIG. 29–DIG. 31, DIG. 42, DIG. 45, DIG. 44

[56] References Cited

U.S. PATENT DOCUMENTS

| | | | |
|---|---|---|---|
| 2,726,003 | 12/1955 | Govatsos | 156/571 |
| 2,764,408 | 9/1956 | Weiler | 156/568 |
| 3,616,093 | 10/1971 | Teed | 156/571 |
| 4,032,388 | 6/1977 | Dunning | 156/571 |
| 4,124,429 | 11/1978 | Crankshaw | 156/364 |

*Primary Examiner*—Michael G. Wityshyn
*Attorney, Agent, or Firm*—Thomas R. Lampe

[57] ABSTRACT

Apparatus for applying labels, coupons or the like to articles transported serially along a predetermined path of movement comprising storage means for the labels, delivery means for removing individual labels from the storage means and bringing the labels into contact with the articles, and applicator means for positively engaging the labels to hold them on the articles after delivery.

9 Claims, 11 Drawing Figures

APPARATUS FOR APPLYING LABELS OR THE LIKE

BACKGROUND OF THE INVENTION

1. Field of the Invention

This invention relates to apparatus for applying labels, coupons or similar items to articles serially moving relative to the apparatus.

2. Description of the Prior Art

A number of devices for applying labels or the like to moving articles are disclosed in the prior art. For example, devices of this type are disclosed in Mudd U.S. Pat. No. 2,033,849, which issued Mar. 10, 1936; Faltot U.S. Pat. No. 3,488,241 which issued Jan. 6, 1970; Zodrow U.S. Pat. No. 3,591,168 which issued July 6, 1971; Beutl U.S. Pat. No. 3,748,210 which issued July 24, 1973; Saso U.S. Pat. No. 3,869,331 which issued Mar. 4, 1975; and Dunning U.S. Pat. No. 4,032,388 which issued June 28, 1977.

It will be appreciated that modern packaging lines are continually being improved so that they operate faster and more efficiently. Often such lines include stations for applying coupons, labels or the like to the moving articles in the line and it is of course necessary that the coupons or labels be applied at high speeds so as not to slow down the progress of the articles being received from upstream stations in the line. Prior art label and coupon applicator devices capable of such high speed performance have been characterized by their complexity and relatively high cost.

It is therefore an object of the present invention to provide an apparatus for applying labels or the like which is capable of performing such function at high speeds and is further characterized by its simplicity and relatively low cost.

BRIEF SUMMARY OF THE INVENTION

The apparatus of the present invention includes storage means for labels or similar items, delivery means for removing the individual labels from the storage means and bringing them into contact with serially moving articles, and applicator means for positively engaging the labels and holding them on the articles after delivery. In particular the delivery means includes label retaining means in the form of vacuum or suction cups which are operatively associated with a movable linkage. The movable linkage is in turn operatively associated with a cam to control the attitude, speed and direction of the cups as they move between the label storage means and the articles. The applicator means includes at least one movable element forming a nip with the articles moving past the apparatus and the delivery means is adapted to serially place labels in the nip whereby such labels are positively retained on the articles as the cups return to the storage means for additional labels. In other words, the pick-up and delivery functions of the label delivery means will not be impeded while the labels are positively retained on the articles for a period sufficient for an adhesive bond to be formed between the labels and articles for example.

DETAILED DESCRIPTION

Figure 1:
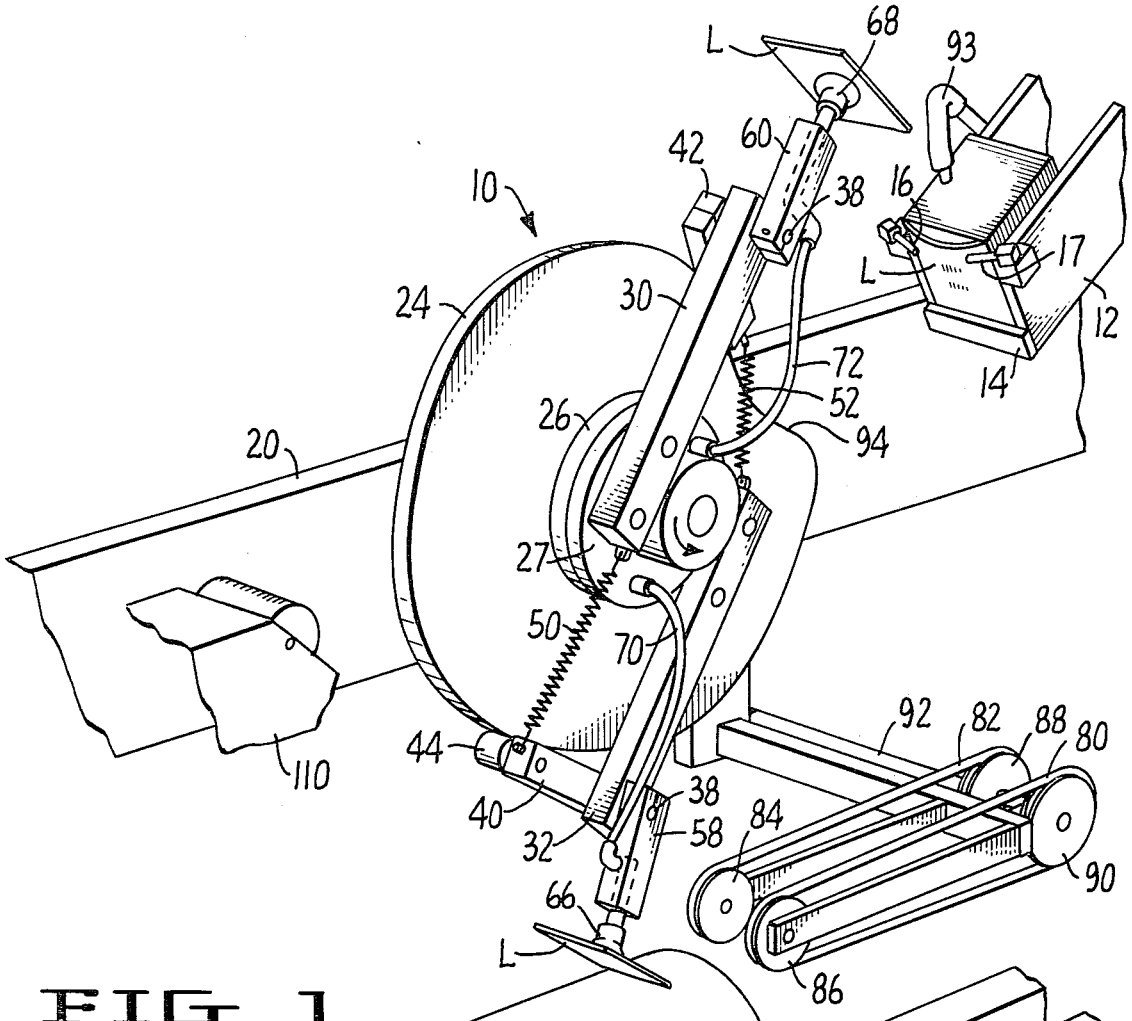
FIG. 1 is a pictorial view of apparatus constructed in accordance with the teachings of the present invention.

Referring to the drawings, apparatus constructed in accordance with the teachings of the present invention is designated generally by reference numeral 10. Apparatus 10 is adapted to apply labels, coupons or other similar items designated L in the drawing to articles moving serially past the apparatus. In the drawings such articles are paper towel rolls T being conveyed under the apparatus by a suitable conveyor mechanism C. It should, however, be appreciated that the apparatus of the present invention may be utilized in association with a wide variety of articles and that any suitable means may be utilized to convey the articles past the apparatus in a serial manner.

The labels, coupons of similar items L to be applied to the articles are retained in stack form in storage means 12 which is essentially in the form of an inclined chute having an open top and end. Gravity fed items L are prevented from falling out of the storage means by bottom flange 14 and adjustable retainer pins 16 and 17.

Rotatably mounted on a frame 20 adjacent to storage means 12 is a support element in the form of a shaft 22. A cam 24 is fixedly attached to bushing 25 which is in turn fixedly mounted on frame 20. Shaft 22 has a pulley 28 fixedly secured thereto, projects through bushing 25 and cam 24, and is rotatably journaled therein. A valve stator 26 is affixed to cam 24. Shaft 22 projects through the stator and is secured to valve rotor 27 so that rotation of the shaft will rotate the rotor relative to the stator. Additional operational details of the valve are set forth below.

Fixedly mounted on rotor 27 are two parallel driver arms 30 and 32. It will be appreciated that the driver arms 30 and 32 will rotate in unison relative to cam 24 upon rotation of shaft 22. Rotatably mounted at the ends of the driver arms 30 and 32 are support pins 36 and 38 to which connector arms 40 and 42, respectively, are fixedly secured. Connector arms 40 and 42 are disposed in engagement with the curved outer cam surface of cam 24 and preferably include rollers 44 and 46 rotatably mounted with respect to the rest of the connector arms to facilitate movement of the connector arms relative to the cam. Connector arms 40 and 42 are continuously urged into engagement with the cam 24 by coil springs 50 and 52 extending between the connector arms and the ends of the driver arms.

Also fixedly mounted on support pins 36 and 38 are auxilliary arms 58 and 60 having mounted at the outer ends thereof suction cups 66 and 68 which are adapted to selectively retain items L thereon upon application of a vacuum thereto in a well known manner. The interiors of cups 66 and 68 are in communication with flexible conduits 70 and 72 through internal passageways (not shown) formed in arms 58 and 60.

Figure 2:
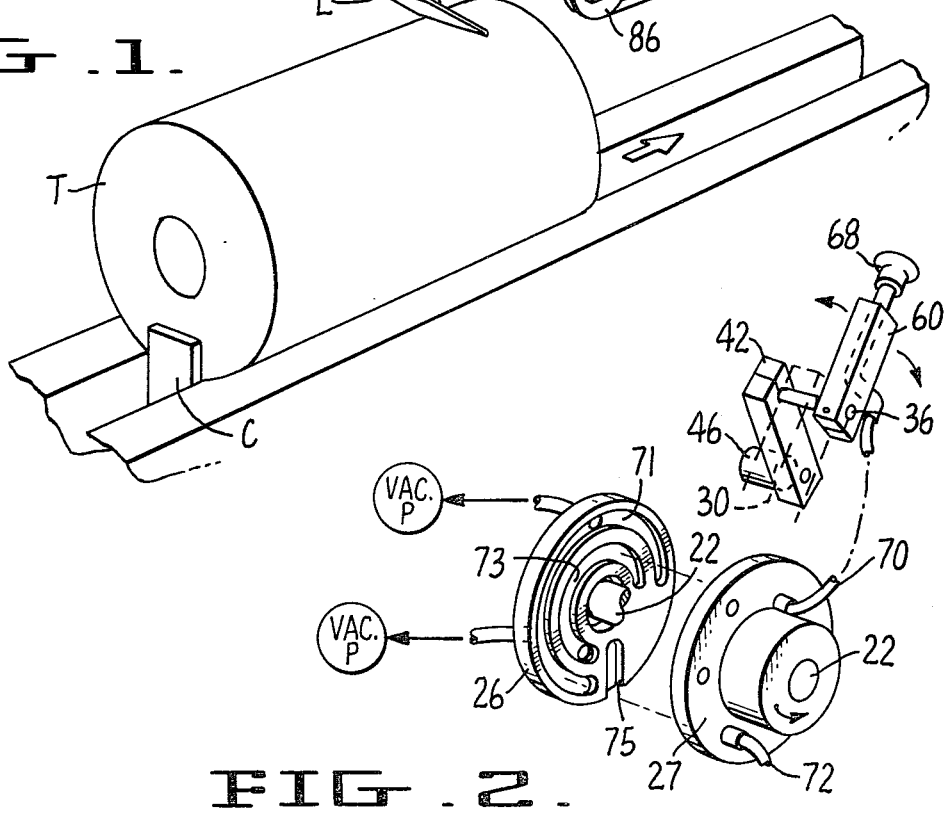
FIG. 2 is an exploded pictorial view showing details of vacuum valve means associated with said apparatus.
Figure 5:
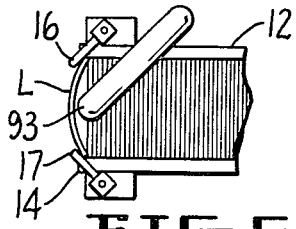
FIG. 5 is a cross sectional view taken along line 5—5 in FIG. 3.

The other ends of conduits 70 and 72 are attached to valve rotor 27. As may best be seen with reference to FIG. 2 the ends of conduits 70 and 72 are offset and in alignment and fluid flow communication with arcuate channels 71 and 73 formed in the inner face of stator 26. The channels in turn are in communication with vacuum sources of any suitable type. It is readily apparent that upon rotation of rotor 27 vacuum will be applied to vacuum cups 66 and 68 as their associated conduits are in registry with the channels formed in the stator. The vacuum to each cup will be borken as the associated conduit passes a slot 75 formed in the stator that is in communication with ambient atmosphere.

From the foregoing it will be understood that rotation of shaft 22 will cause rotation of the driver arms relative to cam 24. Under the continuous bias of coil springs 50 and 52 connector arms 40 and 42 will be maintained in continuous engagement with the outer cam surface and will pivot relative to the driver arms as the outer cam surface is traversed. This pivoting action will also result in a continuous change in the attitude, speed and direction of auxilliary arms 58 and 60 and suction cups 66 and 68. Any suitable means may be utilized to rotate shaft 22 and the other apparatus components connected thereto. It is preferred, however, in order that such rotational speed be precisely integrated with the speed of articles T that a direct gear or belt linkage (not shown) be provided between shaft 22 and the drive means (not shown) of conveyor C or other means employed to transport articles T. Drive arrangements for maintaining a timed relationship between the speeds of moving articles and machine elements are well known in the art and do not comprise part of the present invention. For this reason the drive interconnect between shaft 22 and conveyor C has not been illustrated nor described in detail.

Figure 4:
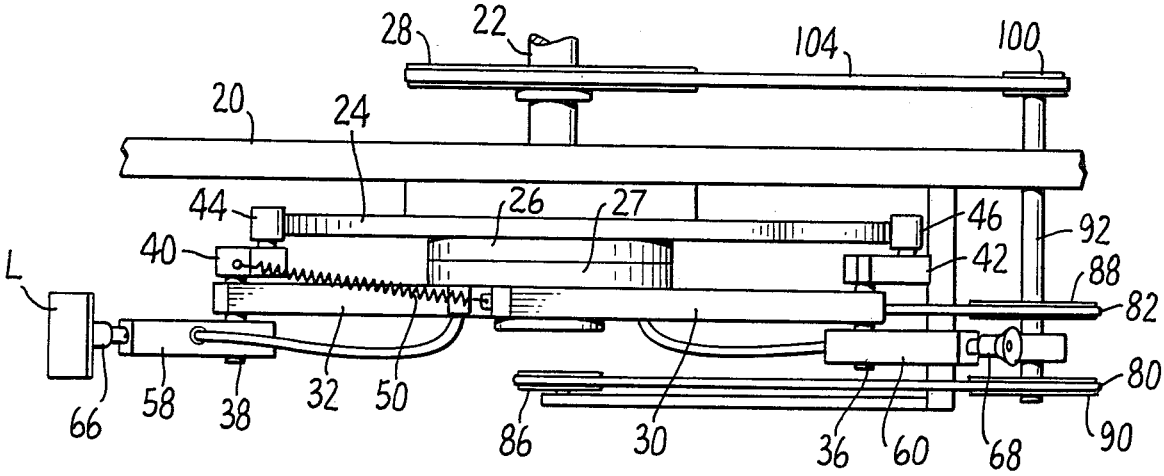
FIG. 4 is a cross sectional view taken along line 4—4 in FIG. 3.
Figure 6:
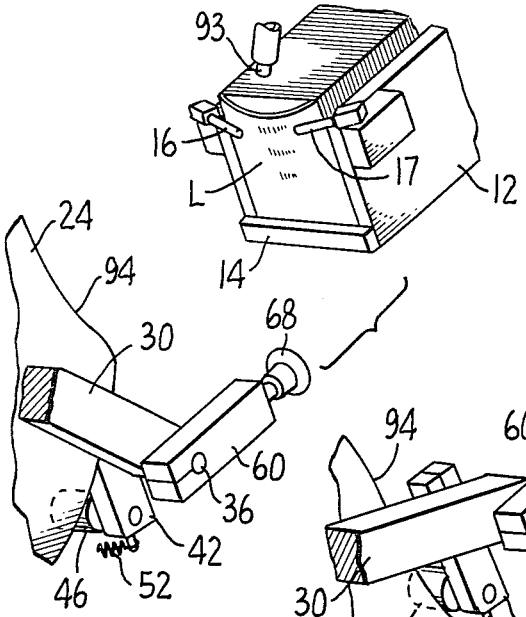
FIGS. 6, 7 and 8 are detail pictorial views illustrating sequential operational steps of coupon removal from coupon storage means.
Figure 7:
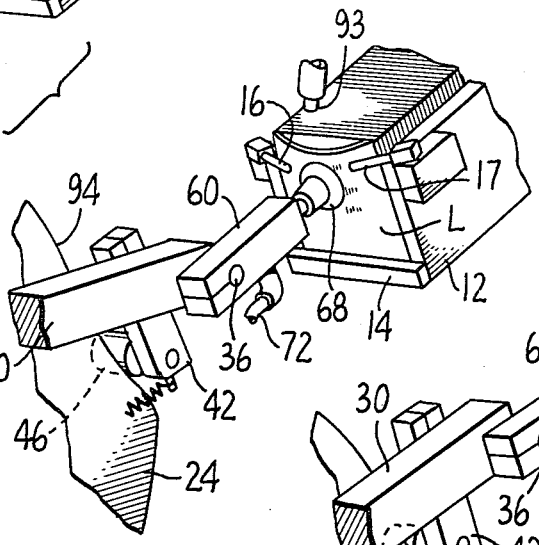
Figure 8:
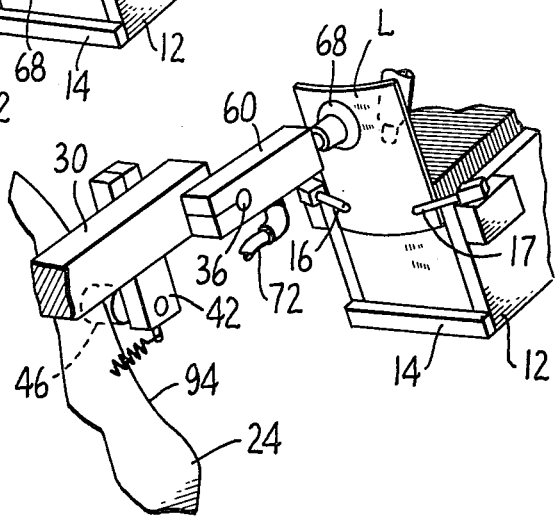

Mounted on frame 20 and disposed over the path of movement of articles T is applicator means for positively engaging items L and holding them onto said articles after delivery of the items by the aforedescribed delivery means. The applicator means includes two endless belts 80 and 82 which are journaled over pulleys 84, 86, 88, 90 mounted for rotatable movement relative to the frame. A drive pulley 100 (FIG. 4) fixedly attached to rotatable shaft 92 upon which pulleys 88, 90 are mounted and interconnected by means of a drive belt 104 to pulley 28 serves to drive endless belts 80 and 82 in response to rotation of shaft 22. The lower runs of belts 80 and 82 define contact surfaces movable with articles T in engagement therewith. As viewed in FIG. 1 belts 80 and 82 rotate in a counterclockwise manner and form a nip with the articles T as the articles pass under the belt.

The operation of the aforedescribed apparatus will now be set forth. As articles T are conveyed under the apparatus in a serial fashion by conveyor C, shaft 22 will be rotated thus rotating driver arms 30 and 32 relative to fixed cam 24. As a suction cup reaches the vicinity of storage means 12, the connector arm operatively associated therewith will engage the relatively indented cam surface portion 94 of cam 24 in the manner shown with respect to suction cup 68 and connector arm 42 in FIGS. 3 and 6–8. This cooperation between the indented cam surface and connector arm will cause the suction cup to tilt so that the outer extremity thereof approaches the item L to be removed from the storage means. Movement of the vacuum cup will be temporarily halted when the vacuum cup and item L are in close proximity. At this time vacuum is applied to the suction cup due to the fact that conduit 72 is in registry with channel 71. Continued movement of the connector arm relative to cam 24 will cause the suction cup to move in the plane of item L thus causing the item to slide endwise. To further improve pick-up reliability storage means 12 is structured so as to bow outwardly the item L at the outer end of the item stack. In particular, an air nozzle 93 is provided to direct a stream of air toward the outermost item to bow it outwardly against retainer pins 16 and 17. Due to the fact that the vacuum cup slides the item L along the face of the adjacent item L and contact between the items has been broken previously by the air stream there is little likelihood of accidental removal of more than one item by the vacuum cup.

Figure 3:
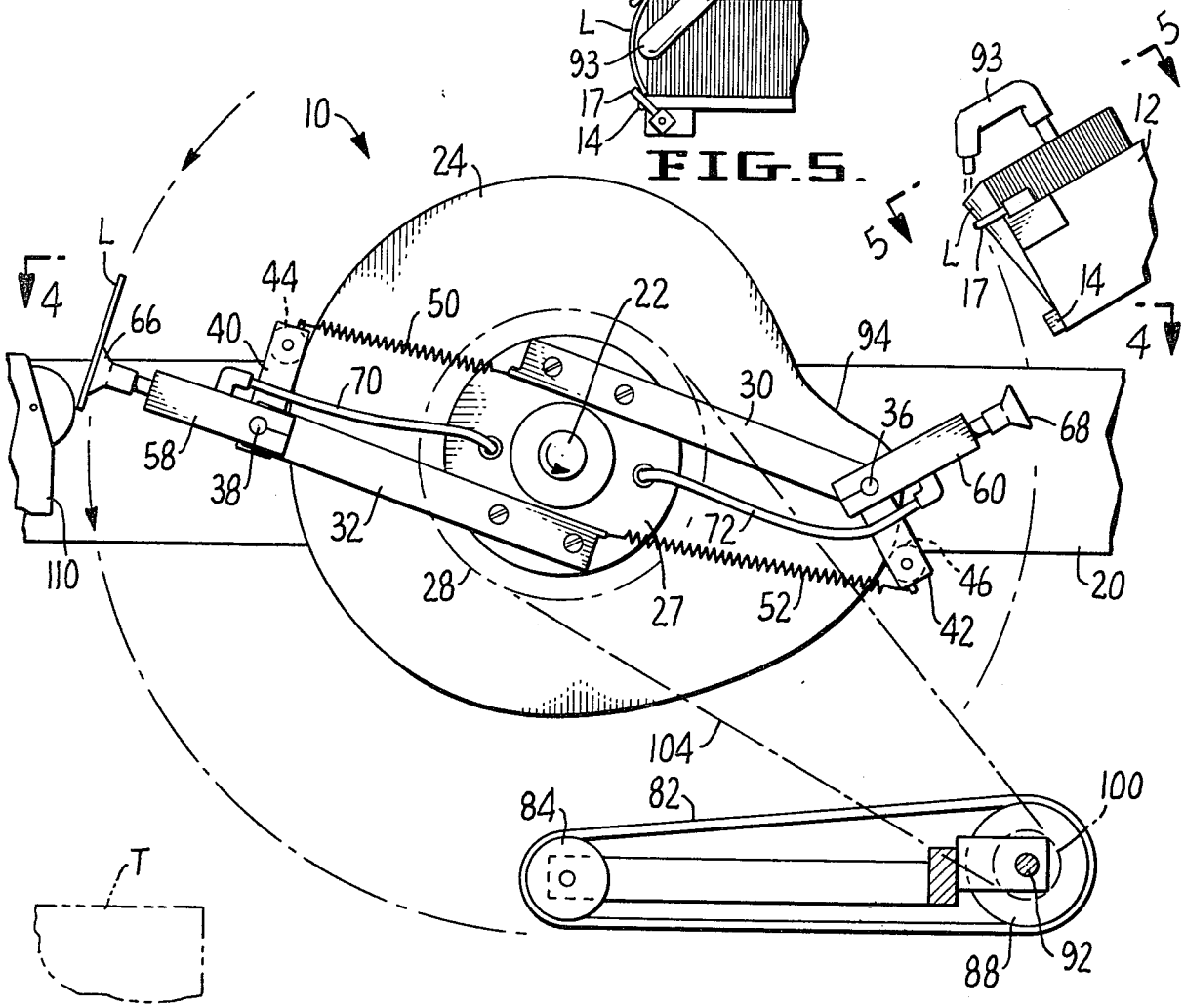
FIG. 3 is a side view of the apparatus of FIG. 1.

At the same time that suction cup 68 is approaching the storage means cup 66 will be in the position shown in FIG. 3 wherein another item L is secured thereto by vacuum due to registry of conduit 70 with channel 73. The item L held by suction cup 66 has in the position illustrated in FIG. 3 just reached a glue applicator 110 of any well known conventional type which will apply glue to the item L held by cup 66. Alternatively, glue jets may be used to apply glue to item L in a conventional manner.

Figure 9:
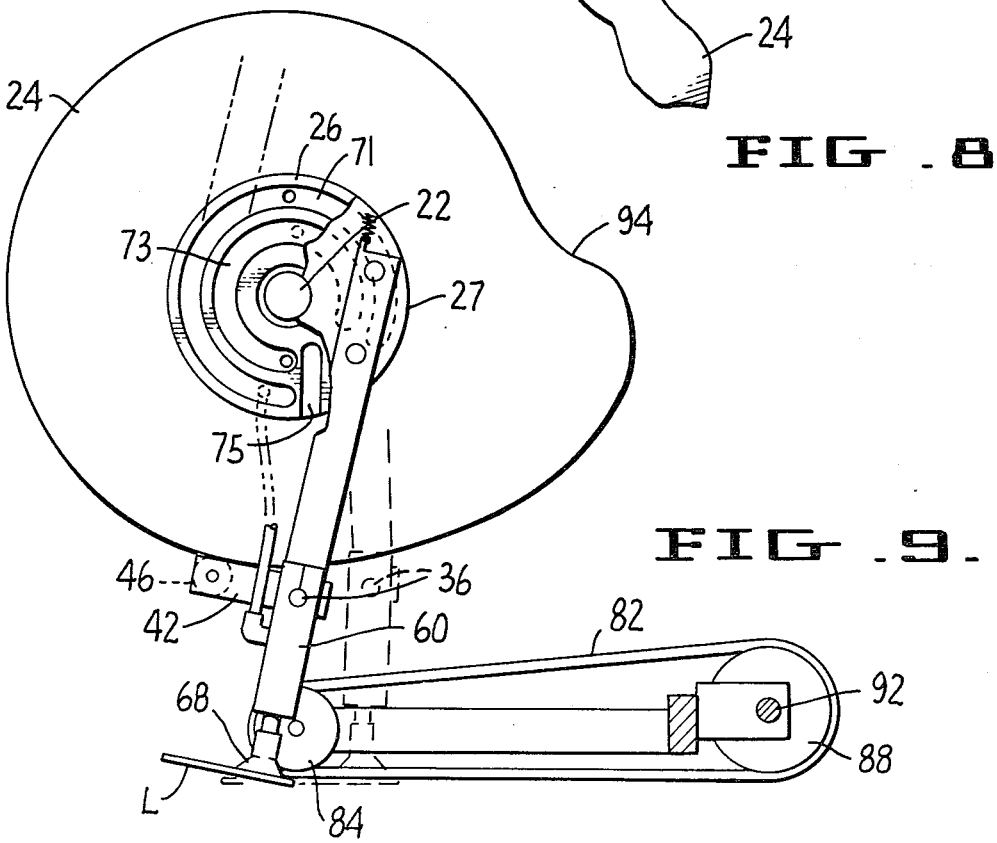
FIG. 9 is a partial side view illustrating the cooperative relationship between the delivery means and applicator means.
Figure 11:
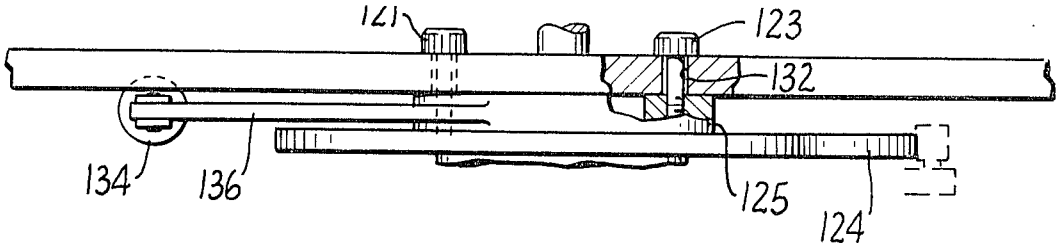
FIGS. 10 and 11 are side and plan views, respectively, of a portion of an alternative form of apparatus.
Figure 10:
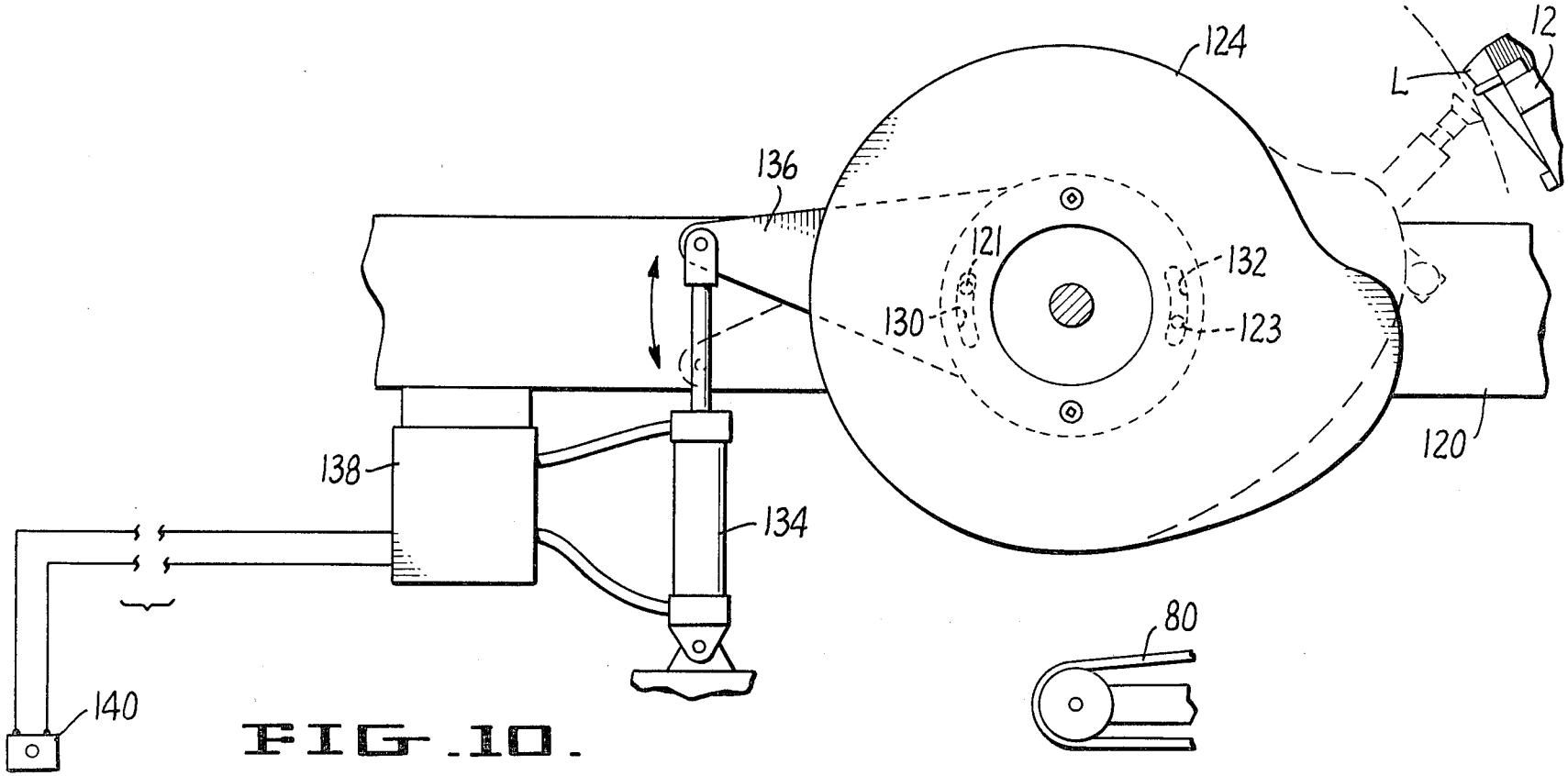

Continued rotation of driver arms 30 and 32 will bring the components of the apparatus into the position illustrated in FIG. 9 wherein the item L held by cup 68 is brought into the nip formed by article T and endless belts 80 and 82. Suction cups 66 and 68 and their associated structure pass between the endless belts as driver arms segments 30 and 32 continue to rotate. The lowermost cam surface of cam 24 is shaped so as to cooperate with connector arms 40 and 42 in such a manner that the speeds of the suction cups 66 and 68 and path of movement thereof approximate that of article T and the lower runs of endless belts 80 and 82. Item L held by the suction cups will be pressed into engagement with article T by the belts 80 and 82 and this pressing action will serve to restrain item L from further movement with the cup as the cup begins to move in an upward direction. The item L will be frictionally engaged by the belts at about the time that the vacuum is broken to the cup due to registry of the conduit associated with the cup with slot 75 in valve stator 26. It will be appreciated that the apparatus just described will normally operate in a continuous fashion as conveyor belt C continuously transports articles T past the apparatus. FIGS. 10 and 11 illustrate an arrangement that may be employed to provide the apparatus constructed in accordance with the teachings of the present invention with a "no product-no label" capability. Specifically, cam 124 and bushing 125 are secured together and mounted for limited rotational movement about stator 126 which is in turn secured in any desired fashion to frame 120. Pins 121 and 123 project from bushing 125 through arcuate slots 130 and 132 which limit the movement of cam 124 and bushing 125 to a few degrees, i.e. between the solid and broken line positions shown in FIG. 10. An air cylinder 134 is attached to an arm 136 projecting from bushing 125 to move the cam and bushing between said solid and broken line positions. The air cylinder is controlled by suitable control means 138 which receives an input from photoelectric cell 140, which is stationed along the path of movement of articles T being conveyed by conveyor mechanism C. In the event cell 140 senses the absence of an article T on the conveyor it will signal control means 138 which will in turn actuate air cylinder 134 to rotate cam 124 to a position whereat the vacuum cup approaching storage means 12 will not come close enough to the outermost label L to remove it from the storage means. Thus, the vacuum cup will not bear an item L at the time it is an item applying position at the location of missing article T. This relatively simple arrangement allows continuous rotation of the apparatus and eliminates the need for secondary valving of the vacuum source.

We claim:

1. Apparatus for applying items such as labels or the like to articles transported serially along a predetermined path of movement comprising:

storage means for said items;

delivery means including item retaining means for removing individual items from said storage means and bringing said items into contact with said articles;

applicator means including a moveable element having a contact surface forming a nip with said articles for positively engaging said items and holding them on said articles after delivery of said items to said articles by said delivery means during transport thereof; and means for moving said delivery means past said applicator means with said item retaining means in close proximity to said nip and adjacent thereto, said article and contact surface cooperable to receive said item in said nip and remove said item from said item retaining means as said delivery means moves past said applicator means.

2. The apparatus of claim 1 wherein said movable element comprises at least one endless belt having a contact surface moveable with said article while in engagement therewith.

3. The apparatus of claim 2 wherein said moveable element comprises two endless belts disposed in parallel to each other and to the path of movement of said articles, each of said endless belts adapted to form a nip with the articles, and said delivery means adapted to pass between said endless belts after placing an item in said nips.

4. The apparatus of claim 1 wherein said means for moving said delivery means includes a moveable linkage connected to said item retaining means and a single cam in operative engagement with said moveable linkage, said moveable linkage and single cam cooperating to provide the sole means of control of the attitude, speed and direction of said item retaining means as said item retaining means moves between said label storage means and said articles.

5. The apparatus of claim 4 wherein said moveable linkage includes at least one driver arm mounted for rotatable movement relative to said single cam and a connector arm rotatably mounted at the end of said driver arm and in operative engagement with the cam surface of said single cam, said item retaining means being connected to said connector arm.

6. The apparatus of claim 5 wherein said applicator means includes an endless belt having a contact surface moveable with said article, said apparatus additionally comprising interconnecting drive means between said endless belt and said driver arm for maintaining a predetermined relationship between the operative speeds thereof.

7. The apparatus of claim 1 wherein said storage means comprises a chute for retaining a stack of items and means including an air jet for bowing the items in said chute prior to removal thereof by said delivery means.

8. The apparatus of claim 7 wherein said bowing means further includes retaining elements for maintaining the item in bowed condition upon application of a stream of air thereto by said air jet.

9. The apparatus of claim 1 wherein said means for moving said delivery means includes a moveable linkage connected to the item retaining means and a cam cooperable therewith to control the path of movement of said item retaining means, said apparatus additionally comprising means for changing the position of said cam in response to absence of an article whereby said delivery means will not remove an item from said storage means for said absent article.

* * * * *